United States Patent [19]

Balzer

[11] 4,367,517

[45] Jan. 4, 1983

[54] ILLUMINATED HANDRAIL ARRANGEMENT

[75] Inventor: Claude P. Balzer, Wichita, Kans.

[73] Assignee: Balco, Inc., Wichita, Kans.

[21] Appl. No.: 181,231

[22] Filed: Aug. 25, 1980

[51] Int. Cl.[3] ..... F21S 1/14

[52] U.S. Cl. ..... 362/146; 362/226; 362/306; 362/326

[58] Field of Search ..... 362/20, 146, 226, 306, 362/368, 326

[56] References Cited

U.S. PATENT DOCUMENTS

| | | |
|---|---|---|
| 541,337 | 6/1895 | Sieburg . |
| 785,695 | 3/1905 | Munns . |
| 1,780,125 | 10/1930 | Goodhouse . |
| 2,310,593 | 2/1943 | Orlicki . |
| 2,479,500 | 8/1949 | Longberg . |
| 2,721,255 | 10/1955 | Lanmon . |
| 2,766,372 | 10/1956 | Albris . |
| 2,772,347 | 11/1956 | Lanmon . |
| 3,057,991 | 10/1962 | Grenadier . |
| 3,131,871 | 5/1964 | Foulds . |
| 3,183,343 | 5/1965 | Blum . |
| 3,448,257 | 6/1969 | Sackett, Jr. . |
| 3,569,689 | 3/1971 | Nestrock . |
| 3,740,541 | 6/1973 | Conradt . |
| 3,813,071 | 5/1974 | Noryd . |
| 3,831,020 | 8/1974 | Paulson . |
| 3,867,621 | 2/1975 | Gewfrtz et al. . |
| 4,161,769 | 7/1979 | Elliott . |
| 4,218,725 | 8/1980 | Heffner et al. ..... 362/20 |

FOREIGN PATENT DOCUMENTS

| | | |
|---|---|---|
| 1589250 | 3/1970 | Fed. Rep. of Germany ..... 362/20 |
| 881445 | 11/1961 | United Kingdom ..... 362/146 |

*Primary Examiner*—Peter A. Nelson

*Attorney, Agent, or Firm*—Litman, Day and McMahon

[57] ABSTRACT

A light emitting mounting bracket is provided for a handrail arrangement. The bracket comprises a body portion which supports the handrail on an associated wall and which has a cavity therein which contains a light emitting source and provides access to associated wall fasteners. A translucent lens is wedgedly and flushly mounted on the bracket so as to give the appearance of being molded therewith, thereby presenting a clean profile.

14 Claims, 9 Drawing Figures

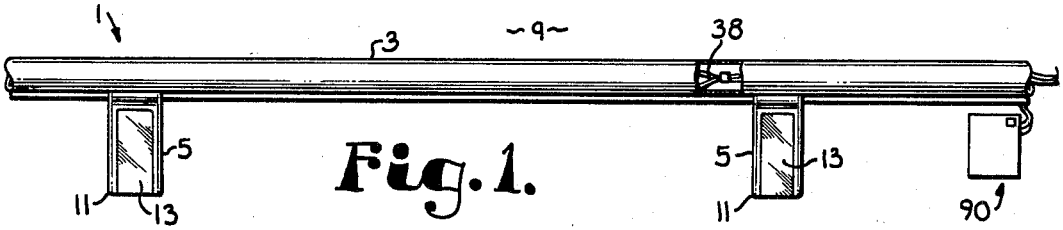
Fig. 1.
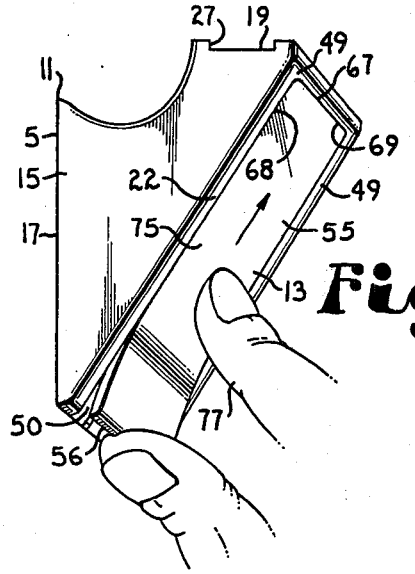
Fig. 5.
Fig. 2.
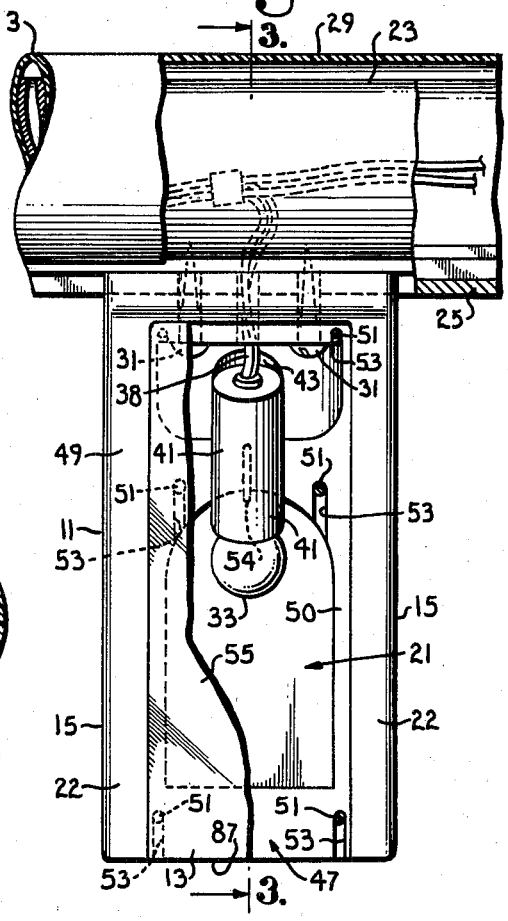
Fig. 3.
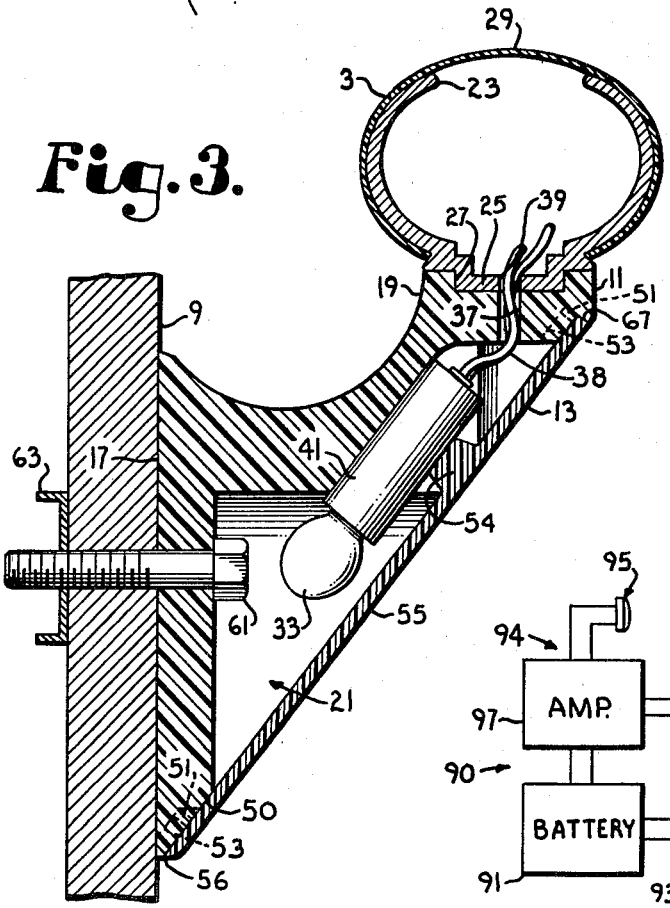
Fig. 4.
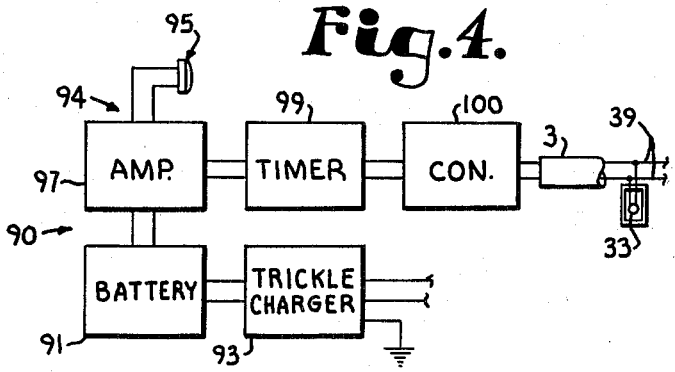

ILLUMINATED HANDRAIL ARRANGEMENT

The use of lighted handrail systems is an old development in architecture. Such systems have been used for decorative light display, as primary lighting for stairs and passageways, particularly in nursing homes and the like, and as secondary or standby lighting to be used when the conventional electrical and lighting system fails.

A drawback in such systems has been that replacement of the bulbs has been a tedious task, requiring at least partial disassembly of the handrail system. Another drawback of such systems has been that the current used to light the bulbs in the system is a standard 115-Volt current, which large voltage has an accompanying safety hazard. A further drawback of such systems is that they are easily tampered with or vandalized in that the fastening devices such as screws which both mount the handrail on an associated wall and which secure the light transmitting lens to the handrail are openly displayed, therefore allowing a vandal to easily disassemble or damage the system. In particular, when it is easily seen how an object is disassembled, there is a tendency, especially in vandals, to do so.

Although it is desired to make the handrail system tamperproof by presenting a clean profile surface, it is also important to be able to quickly and easily service the system, especially to replace burned out light bulbs.

OBJECTS OF THE INVENTION

Therefore, the objects of this invention are: to provide a handrail system wherein the light emitting element therein is easily replaced; to provide such a system wherein the light emitting element is carried in the handrail support brackets; to provide such brackets wherein at least one of the brackets includes a light emitting element and has a body portion and a removable lens portion; to provide such a lens portion that is retained in said body portion without the aid of auxiliary fasteners; to further provide such a lens portion that is wedgedly secured in said body portion and is flushly mounted therewith, thereby giving the appearance of being bonded to the body portion; to provide such a lens portion which mates with the bracket body portion to form a clean or smooth profile therewith to discourage vandalizing; to provide such a lens portion which is easily removable from the body portion by a repairman knowledgable of the handrail system; to provide such a handrail lighting system having a low voltage electrical current therein; to further provide such a system that incorporates therewith the use of a battery, which battery provides the electrical current for the lighting elements and may be utilized for both continuous lighting and emergency lighting if a building's normal lighting system fails due to conventional electrical power failure or the like; to provide such a battery that is constantly charged from a standard 115-Volt circuit through a trickle charger; to provide such an illuminated handrail arrangement which is simple in design, easy to manufacture, capable of an extended useful life and particularly well adapted for the proposed use thereof.

Other objects and advantages of this invention will become apparent from the following description taken in connection with the accompanying drawings wherein are set forth by way of illustration and example, certain embodiments of this invention.

SUMMARY OF THE INVENTION

An illuminated handrail system is provided comprising a substantially elongate handrail and a plurality of mountinng brackets, which brackets support the handrail on an associated wall. Each mounting bracket comprises a one-piece molded body having a cavity therein, which houses the lighting elements, and a translucent molded lens, which is wedgedly and flushly attached to the bracket body portion. The lens includes lugs on an inner side thereof, which lugs slidably mate with molded slots in the body to aid in removably locking the lens in position relative to the body and allow selective separation thereof. The body includes a recess or shoulder to support the lens such that the outer surface of the lens smoothly abuts a mating surface of the body. The handrail is hollow and contains therein electrical wires which run from a battery source to the light emitting elements. The lighting elements may be permanently lighted and/or may be ignited by a timer, photocell, switch or the like. The fasteners, including those fasteners attaching the handrail to the mounting bracket and the mounting bracket to the wall, are accessible within the body portion cavity.

The drawings constitute a part of this specification and include exemplary embodiments of the present invention and illustrate various objects and features thereof.

BRIEF DESCRIPTION OF THE DRAWINGS

FIG. 1 is a partial side elevational view of an illuminated handrail structure embodying the elements of this invention, showing two handrail support brackets and an associated battery according to the present invention, with portions broken away to show details thereof.

FIG. 2 is an enlarged side elevational view of a portion of the handrail structure with sections broken away to show details thereof.

FIG. 3 is a cross-sectional view of the handrail structure taken along line 3—3 of FIG. 2 showing a cavity within one of the mounting brackets.

FIG. 4 is a schematic diagram partially showning the electrical circuitry of the handrail structure.

FIG. 5 is a perspective view of one of the support brackets of the handrail structure showing a step in the replacement of a lens thereon.

DETAILED DESCRIPTION OF THE PREFERRED EMBODIMENT

Figure 6:
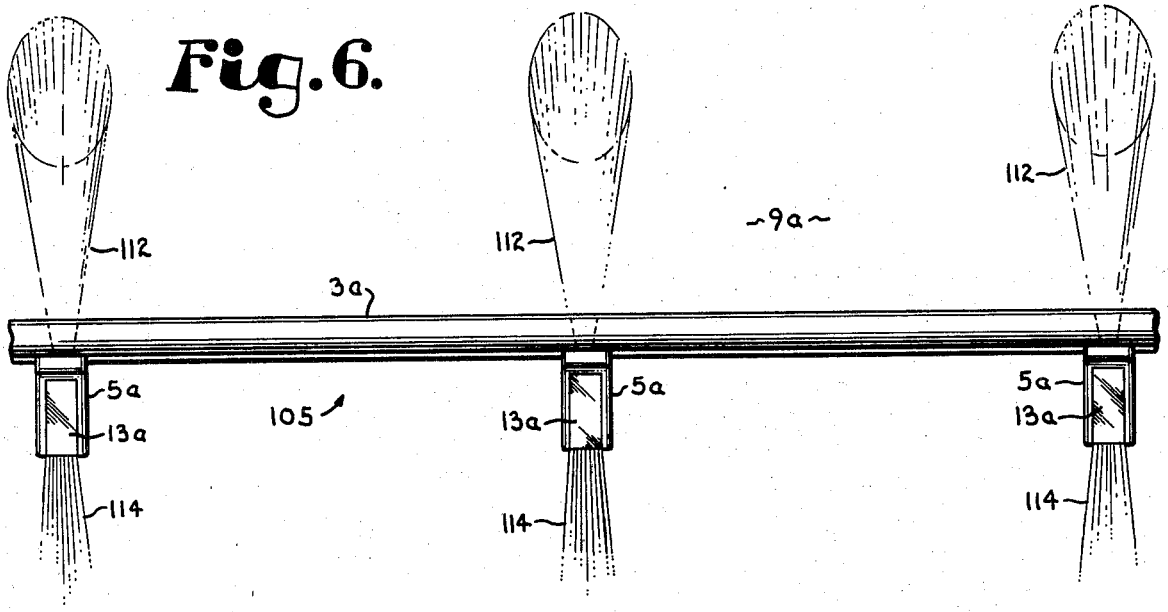
FIG. 6 is a side elevational view of an alternate embodiment of a handrail structure showing the light pattern emitted from mounting brackets thereof.
Figure 9:
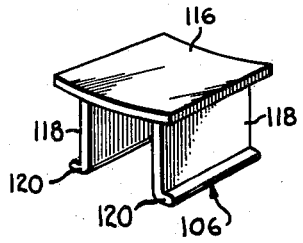
FIG. 9 is a perspective view of a translucent plug which is mounted in one of the support brackets of the alternate embodiment of the handrail structure shown in FIG. 7.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Referring more in detail to the embodiment shown in FIGS. 1 through 5 of the drawings, the reference numeral 1 generally designates an illuminated handrail arrangement embodying the present invention which comprises an elongate handrail 3 and a plurality of mounting brackets 5. As shown in FIG. 3, the mounting brackets 5 are securely positioned on an associated wall 9 and retain the handrail 3 in spaced apart relation therefrom. Directional terms used herein are understood to refer to the orientation of the handrail arrangement 1 shown in FIGS. 2 and 3 and in particular the term "upper" means to the top of the page in FIG. 2 and the term "outer" means to the right in FIG. 3 with respect to a surface of one of the brackets 5.

Each of the mounting brackets 5 comprise a load supporting body portion 11 and a light transmitting lens 13. The body portion 11 is of one-piece construction and is preferably injection molded of a suitable material which has the properties of being substantially rigid and weight supportive but resilient. The body portion 11 is generally triangular in side view and comprises two substantially vertical spaced apart side members 15, a substantially vertical support wall engaging surface 17, an upwardly extending handrail supporting shoulder 19, an inwardly projecting cavity 21 and a front wall 22 which angles downwardly toward the wall 9 from the shoulder 19 to a bottom edge 20 of the wall engaging surface 17.

The handrail 3 comprises an inner structure 23 formed of a suitable non-pliable and supportive material such as extruded aluminum. The inner structure 23 comprises a partial oval in cross-section with an upwardly projecting opening 24 and has a rib 25 which extends downwardly therefrom, which rib 25 is received within a groove or recess 27 in shoulder 19. Except for the rib 25, the handrail inner structure 23 is encased in an outer skin or sleeve 29 which is slidably received over the handrail inner structure. The sleeve 29 is generally suitable for gripping and may be constructed from a pliable extruded plastic or the like. The handrail 3 is secured to the shoulder 19 by means of fasteners such as self-tapping screws 31.

A light emitting source such as a light bulb 33 is received in each cavitty 21. Electrical wires 38 which are necessary to provide the current for the light bulbs 33 project upwardly from the light bulb 33 through aligned apertures 37 and 39 in the bracket shoulder 19 and handrail inner structure 23 respectively and are contained internally of the handrail 3 throughout the length thereof. Each light bulb 33 is received in a suitable socket 41 which in turn is snugly and wedgedly retained in a substantially cylindrical channel 43 in cavity 21. Each bracket 5 if formed of a material which has a relatively high durometer reading but yet retains a certain amount of resiliency. Because of the resiliency, the socket 41 can be urged or wedged into the channel 43 and snugly retained therein.

The lens 13 is formed of a similar material as the body portion 11, except the body portion 11 is generally opaque and the lens is generally clear or at least partly translucent. The lens 13 is wedgedly and snappedly retained within a slot 47 which is defined in the bracket front wall 22 so as to be snugly received therein. The slot 47 of the present illustrated embodiment is substantially rectangular in shape and generally coextensive to the shape of the lens 13. A recessed surface, ridge or shoulder 50 spaced from an outer surface 49 of the front wall 22 approximately the width of the lens 13, supports the lens 13. The lens 13 has projecting inwardly therefrom lugs 51 at both ends thereof and in a central location, which lugs 51 mate with grooves 53 formed in the mounting bracket 5 to further aid in securing the lens 13 to an associated bracket body portion 11. It is noted that grooves 53 are formed contemporaneously with the molding of the body portion 11. A ridge 54 projects inwardly from lens 13 in contact socket 41 when the lens 13 is secured to the bracket, thereby further retaining the socket 41 in channel 43.

The lens 13 is preferably approximately the same size or even slightly larger than the slot 47; and because of the resilient nature of the material, the lens 13 can be wedged into slot 47 and snugly retained therein. It is noted that as shown in FIG. 5, an outer surface 55 of the lens is secured flush or generally coplanar with the bracket front wall surface 49, thereby presenting a clean profile to an observer and giving the appearance that both the bracket body 11 and lens 13 are of one piece or fixedly attached construction. However, a lower edge 56 of the lens 13 may be pried by means of friction with a finger of a user, a finger nail of a user or other suitable instrument from the engagement thereof with the bracket body 11 to allow access to the cavity 21 to replace the bulb 33 or the like. The lens 13 is preferably sufficiently pliable to aid in removal thereof from a bracket body.

Each of the mounting brackets 5 are secured to the wall 9 by means of a fastener such as a bolt 61 or the like, which bolt is retained in the wall by means of a locking channel or suitable retainer such as butterfly 63. The bolts 61 and screws 31 are both accessible only upon removing the lens 13 from the mounting bracket. Therefore, there is no visible means of fastening the bracket to the wall 9 or to the handrail 3. Because of this, vandals will be dissuaded from damaging or disassembling the handrail, since the parts thereof most often disassembled are within the lens covered cavity 21.

In placing the lens 13 on the bracket body portion 11, a top edge 67 of the lens 13 is manipulated so as to be wedged within a top portion 68 of an associated bracket slot 47 such that upper lugs 51 are positioned in corresponding body portion grooves 53 and snappedly received therein. Then pressure is applied to a middle section 75 of the lens surface 50, as is shown in FIG. 5, by a suitable means such as a fore finger 77 of a user, which pressure forces the middle section 75 of the lens 13 into the slot 47 and lugs 51 associated with the middle of the lens 13 into corresponding body portion grooves 53. The user applies force in the direction of the arrow as shown in FIG. 5 to push the lens top edge 67 snugly against a bracket slot top edge 69. Then the lugs 51 associated with the bottom of the lens 13 are forced into corresponding grooves 53 to flushly position the lens 13 with respect to the mounting bracket wall 22. As shown in FIG. 1, when the lens 13 is in position, there is no observable element of the mounting bracket construction that would indicate to a vandal the method of securing the bracket to the wall, the handrail to the bracket, or the lens to the bracket. It is noted that the lower edge 56 of the lens 13 is not normally viewable to a user of the handrail arrangement 1, and this tends to prevent tampering therewith, since the lens 13 is easily removed only by outward pressure on the edge 13; and what is out of sight is often not manipulated by a would-be vandal or the like. It is also noted that the clean profile of the lens 13 gives the appearance that the lens 13 is glued or otherwise fixedly attached to the body portion 11, thereby urging a would-be vandal to believe the contents of the body portion 11 are not easily accessible, whereas a person trained in the configuration of the handrail arrangement 1 can easily remove the lens 13 to effect repairs in the cavity 21.

To remove the lens, it is only necessary to wedge a suitable thin object such as a finger nail (not shown) or the like between the lens 13 and the bracket body portion 11 at the lower edge 56 of the lens 13, such as at 87 and pry the lens 13 from the body 11.

Electrical current is provided to the light bulb through a power source 90 as shown in FIG. 4 which can be recessed into the wall 9. The illustrated power source 90 comprises a six volt D.C. battery 91, which is continually charged through an associated conventional 115-Volt A.C. circuit by means of a trickle charger 93. The power source 90 further may include an automatic activation system 94 which preferably is used to regulate the periods of use of the handrail arrangement 1. As shown in FIG. 4, a photoelectric cell 95 is exposed to the ambient lighting condition. Electrical impulses are transmitted from the photoelectric cell 95 through an amplifier 97 to a timing device 99. The timing device 99 is designed to detect the amount of ambient light and also incorporates therewith a timer which times the length of the periods of low ambient light, thereby assuring that short transient changes of light such as shadows do not trigger the activation system 94. The timing device 99 can be adjusted to allow for lighting at varying degrees of ambient light and also varying lengths of light deficiencies. If the period of low light is sufficiently long, the timing device 99 will allow current in the battery 91 to flow through the circuitry to the bulbs 33 by means of electrical connector 100 which connects to wires 38 suitably located within the handrail 3 and interconnected with each of the bulbs 33. A manual switch (not shown) may also be used to selectively ignite the bulbs 33.

An alternate embodiment of the illuminated handrail arrangement 105 is shown in FIGS. 6 through 9. Since many of the elements of the alternate embodiment of FIGS. 6 through 9 are similar to the embodiment of FIGS. 1 through 5, like numbers will be used to describe similar parts of the alternative embodiment, with the addition of the letter "a".

Figure 7:
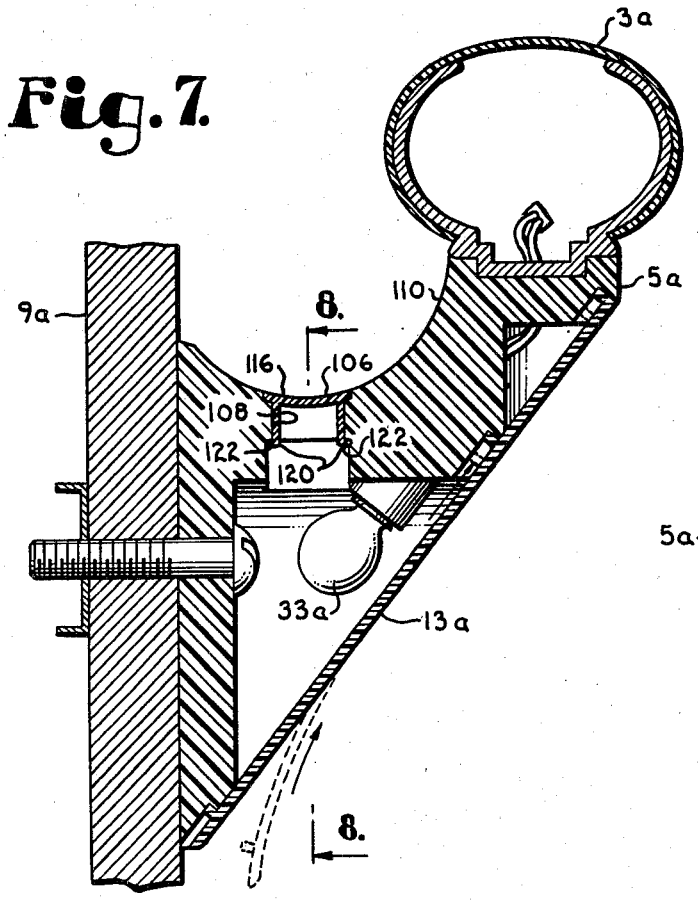
FIG. 7 is a cross-sectional view of the alternate embodiment of the handrail structure shown in FIG. 6 showing detail of one of the mounting brackets.
Figure 8:
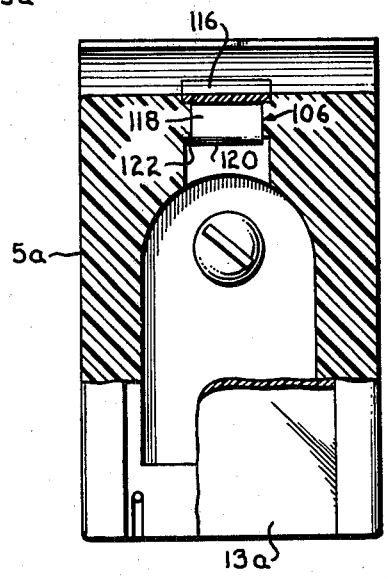
FIG. 8 is a cross-sectional view of the alternative embodiment of the handrail structure of FIG. 7 showing the mounting bracket taken along lines 8—8.

Referring to FIG. 7 in the alternative embodiment, a transparent or translucent window plug 106 is received within an aperture or channel 108 which communicates with a body portion cavity **21*a* and an arcuate top surface 110 of mounting bracket 5*a*. Light emitting from a light bulb 33*a* passes through both a transparent or translucent lens 13*a* and the window 106, thus providing both an upwardly and downwardly-outwardly oriented patterns of light, 112 and 114 respectively, as seen in FIG. 6. The light pattern 112 impinges on a wall 9*a* to light the environment of the handrail arrangement 105 while the light pattern 114 lights a floor (not shown) including steps or the like running adjacent the wall 9*a* associated with the handrail 3*a*, so as to assist a user of the handrail 3*a*, by providing improved lighting. Such lighting is especially useful in a failure of a conventional power supply, in which case a battery (not shown) similar to the battery 91 of the previous embodiment can be utilized to provide emergency lighting by means of the handrail 3*a***.

The window 106 comprises a transparent or translucent top portion 116 and depending legs 118 which have at their lower end two outwardly projecting tabs 120. The tabs 120 are fabricated so as to be resiliently biased in opposed directions thereby securely engaging associated shoulders 122 of the channel 108, and retaining the window plug 106 in position. Once the plug 106 is positioned within an associated channel 108, a clean profile as shown in FIG. 7 exists between the body portion **5*a* and the window top portion 116 upper surface. In addition, the plug 106 cannot be removed without removing the lens 13*a***.

It is foreseen that the mounting bracket body portion may alternatively be molded so as to be either opaque or translucent. Also, the lens can be molded so as to allow the transmittal of clear of colored light therethrough. Translucent body portions can be matched with lens of differing color to create a desired light pattern. It is noted that in some installations that not all of the brackets need to be provided with a light and a lens.

It is also foreseen that the alternate embodiment lenses and plug windows can be matched colorwise to produce a desired color pattern.

Thus, a handrail arrangement is provided in which all of the associated fasteners are hidden from view yet which is capable of easy repair, easy bulb replacement, and is of one piece low-cost construction.

It is to be understood that while certain embodiments of the present invention have been illustrated and described herein, it is not to be limited to a specific form or arrangement of parts described and shown, except as noted in the claims.

I claim:

1. In a light emitting handrail system including a substantially elongate handrail supported on an associated wall by mounting brackets, the improvement comprising:

(a) at least one of said brackets having a body portion with an internal light source and a slot communicating between said light source and the external environment of said handrail; said body portion having an external surface, said slot exhibiting a size and shape to accomodate a lens;

(b) a resilient light transmitting lens having a shape commensurate with said slot shape and having a size slightly larger than said slot size, aid lens being wedgedly and resiliently received in said slot; said lens having an external surface cooperating with said body portion external surface so as to be flush therewith, thereby producing a substantially clean outer profile on the mounting bracket.

2. The handrail system as in claim 1 wherein:

(a) said mounting bracket body portion includes a cavity therein; said cavity receiving said light source;

(b) said body portion includes fastening means for securing said body portion to said handrail and to the associated wall; said fastening means being positioned within and accessible only from within said cavity; and (c) said lens covers said cavity so as to render said cavity inaccessible when said lens is placed thereon, thereby reducing access and vandalism to said light source and said fastening means.

3. The handrail system as in claim 1 wherein:

(a) said lens is transparent and said body portion is opaque.

4. The handrail system according to claim 1 wherein:

(a) said body portion has a recessed shoulder associated with said slot and positioned approximately the thickness of said lens from said body portion surface in said slot; and (b) said shoulder receiving said lens thereon when said lens is positioned in said slot.

5. The handrail system according to claim 1 or 4 wherein:

(a) one of said body portion and said lens includes a plurality of lugs thereon and an opposite one of said body portion and said lens includes a plurality of lug receiving grooves therein; said lugs snugly mating with said grooves when said lens is positioned on said body portion to retain said lens thereon.

6. The handrail system according to claim 5 wherein:

(a) said grooves are on said body portion.

7. The handrail system according to claim 6 wherein:

(a) said body portion is molded as a single piece including said grooves therein.

8. The handrail system according to claim 1 or 4 wherein:

(a) said lens has a lower edge when positioned on said body portion; said lower edge being accessible to pry said lens from said body portion to allow access to an interior of said body portion; and said lower edge being substantially hidden from view of a user of said handrail system such that availability of access to said body portion interior is not readily apparent to such a user.

9. The handrail system according to claim 1 wherein said handrail includes:

(a) a substantially rigid interior tube having an open access slot extending axially along a surface thereof; said tube including an electricity conducting wire therein;

(b) said tube being attached near a lower side thereof to each of said brackets and communicating therewith so as to provide access within each of said brackets to said wire; and (c) a handgripping sleeve slidably mounted over an upper side of said tube, whereby said sleeve may be selectively removed from said tube to provide access for installation or repair of said system.

10. The handrail system according to claim 1 including:

(a) a low D.C. voltage source for providing energy to said light source, thereby reducing chance of electrical shock to a user thereof; said voltage source including standby reserve to provide voltage and thereby light source during failure of conventional lighting in the environment of said handrail.

11. The handrail system according to claim 10 including:

(a) switch means to selectively ignite said light source.

12. The handrail system according to claim 11 wherein:

(a) said handrail includes wiring; said wiring being accessible only through the interior of said bracket body portion.

13. In a handrail system having a plurality of spaced light emitting brackets each having a light source and associated electrical wiring therein, the improvement comprising:

(a) an elongate substantially rigid tube generally extending the length of said handrail system and having an open access slot extending axially therealong allowing access into an interior thereof, said tube being attached at a lower side thereof to each of said spaced brackets, said tube interior including electrical wiring therein connected to said braacket wiring; and (b) an elongate handgripping sleeve slidably retained axially on said tube in covering relation to said slot, whereby said sleeve may be selectively removed from said tube to provide access for installation or repair of said system.

14. In a light emitting handrail system including a substantially elongate handrail supported on an associated wall by mounting brackets, the improvement comprising:

(a) at least one of said brackets having a body portion with an internal light source and a slot communicating between said light source and the external environment of said handrail; said body portion having an external surface;

(b) a light transmitting lens snugly and removably received in said slot; said lens having an external surface cooperating with said body portion external surface so as to be flush therewith, thereby producing a substantially clean outer profile on the mounting bracket; wherein (c) said lens transmits light outwardly and downwardly with respect to the associated wall; and (d) said body portion includes a light transmitting window positioned on a top surface thereof so as to illuminate an upper portion of the associated wall; said window forming a clean profile with respect to said body portion top surface.

* * * * *